US007119297B2

(12) United States Patent
Katagiri

(10) Patent No.: US 7,119,297 B2
(45) Date of Patent: Oct. 10, 2006

(54) PUSH BUTTON

(75) Inventor: Katsuhiro Katagiri, Aichi-ken (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 10/952,840

(22) Filed: Sep. 30, 2004

(65) Prior Publication Data

US 2005/0072661 A1 Apr. 7, 2005

(30) Foreign Application Priority Data

Oct. 2, 2003 (JP) ..... 2003-344556

(51) Int. Cl.
*H01H 3/12* (2006.01)

(52) U.S. Cl. ..... 200/345; 341/520

(58) Field of Classification Search ..... 200/341–345, 200/520, 510, 512–517
See application file for complete search history.

(56) References Cited

U.S. PATENT DOCUMENTS 5,201,409 A * 4/1993 Martin et al. ..... 200/345
5,345,051 A * 9/1994 Miike ..... 200/345
6,335,499 B1 * 1/2002 Kokubu et al. ..... 200/341
2005/0034965 A1 * 2/2005 Uehira ..... 200/341

FOREIGN PATENT DOCUMENTS

EP 279784 A2 * 8/1988
JP 2000306460 A * 11/2000
JP A-2000-306460 11/2000

* cited by examiner

*Primary Examiner*—Elvin Enad
*Assistant Examiner*—M. Fishman
(74) *Attorney, Agent, or Firm*—Posz Law Group, PLC

(57) ABSTRACT

A push button includes a button body, and a panel body. The button body includes a cylinder, a presser, and a rim. The cylinder has opposite ends, and an outer peripheral shape. The presser is disposed at one of the opposite ends of the cylinder, and forms a pressing surface. The rim protrudes beyond the outer peripheral shape of the cylinder, and has a rear surface facing the pressing surface back-to-back. The panel body includes a cylinder-shaped holder, a main body, and a flange. The cylinder-shaped holder holds the button body therein so as to enable the button body to reciprocate in an axial direction of the cylinder, and has an opening. The main body demarcates the opening of the cylinder-shaped holder. The flange protrudes radially inward, and has a leading end to be brought into contact with the rear surface of the rim.

20 Claims, 4 Drawing Sheets

PUSH BUTTON

BACKGROUND OF THE INVENTION

1. Field of the Invention

The present invention relates to a push button. More particularly, it relates to a push button comprising a button body and a panel body wherein the inside is invisible through a clearance between the button body and the panel body when the button body is pushed into the panel body. Moreover, it relates to a push button which hardly damages interiors such as circuit substrates and switches.

2. Description of the Related Art

The operations of various apparatuses are controlled with switches which are disposed on and assembled with a circuit substrate. In such apparatuses, the circuit substrate is held in a case, and accordingly switches disposed on the circuit substrate are also held in the case. The switches are operated in turn with operating means, such as push buttons, disposed in the case.

A push button for such an application is disclosed in Japanese Unexamined Patent Publication (KOKAI) No. 2000-306,460, for instance. The patent publication discloses a display apparatus in which an operating portion of a push button for switching is fitted into an opening in a panel structure (or an exterior panel) of a display unit and is supported by an elastic member. The display apparatus is characterized in that the push button has a tapered structure on a rear side of the operating portion; the panel structure has an inclined portion disposed at an opening periphery on a rear side of the opening; and a restoring force of the elastic member pushes the tapered structure onto the inclined portion.

In the push button disclosed in the patent publication, the inclined surface disposed at the opening periphery in the panel structure is brought into close contact with the tapered surface in the tapered structure disposed on a rear side of the operating portion of the push button. Thus, the push button is positioned with respect to the panel structure with high accuracy.

In such a conventional push button, the pushing-in of the operating portion is regulated by the elastic member alone. Accordingly, there is a fear that the push button might be damaged when the operating portion is pushed in too hard. Moreover, when the operating portion is pushed in too hard, excessive forces are applied to a switch, which is operated by the push button, and a circuit substrate, with which the switch is assembled. Consequently, there is a problem that damages might occur in the switch and circuit substrate.

Moreover, in such a conventional push button, a clearance exists between the outer peripheral surface of the operating portion of the push button and the inner peripheral surface of the panel structure. When the operating portion of the push button is pushed into the panel structure, interiors such as the circuit substrate which is hidden inside is visible through the clearance between the operating portion and the opening of the panel structure. Thus, there arises another problem that the appearance of the display apparatus might degrade.

SUMMARY OF THE INVENTION

The present invention has been developed in view of such circumstances. It is therefore an object of the present invention to provide a push button, which comprises a button body and a panel body and which scarcely damages interiors such as circuit substrates and switches when the button body is pressed into the panel body too hard. Moreover, it is a further object of the present invention to provide a push button which makes the inside invisible.

While trying to solve the aforementioned problems, the inventor of the present invention thought of the following push button. The push button comprises a presser, a cylinder-shaped holder, and a rim and/or flange formed so as to cover a clearance between the outer peripheral surface of the presser and the inner peripheral surface of the cylinder-shaped holder. Thus, the present inventor solved the problems.

Specifically, a push button according to the present invention comprises:

- a button body comprising: a cylinder having opposite ends and an outer peripheral shape; a presser disposed at one of the opposite ends of the cylinder and forming a pressing surface; and a rim protruding beyond the outer peripheral shape of the cylinder and having a rear surface facing the pressing surface back-to-back; and
- a panel body comprising: a cylinder-shaped holder holding the button body therein so as to enable the button body to reciprocate in an axial direction of the cylinder, the cylinder-shaped holder having an opening; a main body demarcating the opening of the cylinder-shaped holder; and a flange protruding radially inward and having a leading end to be brought into contact with the rear surface of the rim.

The present push button comprises the button body provided with the rim, and the cylinder-shaped holder provided with the flange. The flange is brought into contact with the rim, and thereby regulates the displacement of the button body.

In a second aspect of the present invention, one of the button body and the panel body further comprises a tapered surface at a position where the cylinder and the cylinder-shaped holder face to each other, the tapered surface being inclined with respect to an axial direction of the one of the button body and the panel body; and the other one of the button body and the panel body further comprises a boss to be brought into contact with the tapered surface.

In the second aspect of the present invention, the present push button comprises the tapered surface, and the boss. The boss is brought into contact with the tapered surface, and thereby guides the movement of the button body or the panel body.

In a third aspect of the present invention, the rim of the button body is disposed to the presser thereof.

In the third aspect of the present invention, the rim of the button body is disposed to the presser thereof. Accordingly, it is possible to dispose the pressing surface of the presser so as to be flush with an exterior surface in the main body of the panel body. Consequently, the decorative appearance of the present push button is furthermore enhanced.

In a fourth aspect of the present invention, the flange of the cylinder-shaped holder is disposed over an entire circumference in a peripheral direction of the cylinder-shaped holder.

In the fourth aspect of the present invention, the flange of the cylinder-shaped holder is disposed over an entire circumference in a peripheral direction of the cylinder-shaped holder. Accordingly, the flange disposed over the entire circumference of the cylinder-shaped holder receives forces pressing the button body into the panel body. Consequently, no stresses are applied to the cylinder-shaped holder locally.

In the present push button, the button body comprises the rim, and the cylinder-shaped holder of the panel body comprises the flange. When the presser is pushed into the main body of the panel body inward, the presser displaces inside the main body inward, and the rear surface of the rim contacts with the flange. When the rim thus contacts with the flange, the button body is inhibited from displacing. Accordingly, the button body cannot be pushed into the panel body more than necessary. Consequently, no excessive forces are exerted to circuit substrates or switches which are operated by the present push button. As a result, the present push button scarcely damages circuit substrates or switches. Moreover, the rim of the button body and/or the flange of the panel body make the interiors, such circuit substrates and switches, invisible through a clearance between the button body and the panel body.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
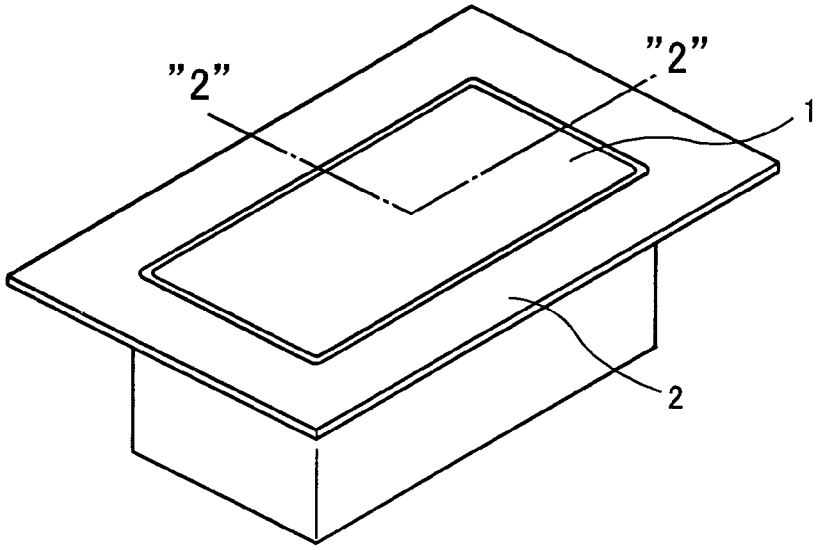
FIG. 1 is a perspective view for illustrating a push button according to Example No. 1 of the present invention.

Having generally described the present invention, a further understanding can be obtained by reference to the specific preferred embodiments which are provided herein for the purpose of illustration only and not intended to limit the scope of the appended claims.

The present push button comprises a button body, and a panel body.

The button body comprises a cylinder, a presser, and a rim. The cylinder has opposite ends and an outer peripheral shape. The presser is disposed at one of the opposite ends of the cylinder, and forms a pressing surface. The rim protrudes beyond the outer peripheral shape of the cylinder, and has a rear surface facing the pressing surface back-to-back. Moreover, the panel body comprises a cylinder-shaped holder, a main body, and a flange. The cylinder-shaped holder holds the button body therein so as to enable the button body to reciprocate in an axial direction of the cylinder. The cylinder-shaped holder has an opening. The main body demarcates the opening of the cylinder-shaped holder. The flange protrudes radially inward, and has a leading end to be brought into contact with the rear surface of the rim.

In the present invention, note that the button body comprises the rim protruding beyond the outer peripheral shape of the cylinder and having a rear surface facing the pressing surface back-to-back; and the cylinder-shaped holder comprises the flange protruding radially inward and having a leading end to be brought into contact with the rear surface of the rim.

The rim of the button body is larger than the cylinder thereof, because the button body comprises the rim. As a result, the rim can contact with the flange of the cylinder-shaped holder.

The rim can be disposed to either one of the presser and cylinder of the button body, as far as the rim can contact with the flange of the panel body. In view of manufacturing the button body and the assemblage operability of the button body with the panel body, it is preferable to dispose the rim to the presser. That is, the rim can preferably be formed as a part of an outer peripheral shape of the presser, outer peripheral shape which is made larger than the outer peripheral shape of the cylinder. For example, when the rim is disposed to the presser, a surface of the rim can either agree with the pressing surface of the presser, or can be positioned slightly inward with respect to the pressing surface of the presser.

Since the panel body comprises the flange, it is possible to inhibit the button body from being pushed into the panel body beyond the position at which the flange is formed. That is, the present push button can determine the magnitude for pushing in the button body. This implies that it is possible to prevent an operator from applying a force to switches and circuit substrates equipped with switches more than necessary and eventually to inhibit the switches and circuit substrates from being damaged.

The flange can contact with the rear surface of the rim at the leading end. The leading end herein designates the flange's protruding leading end surface and portions adjacent to the leading end surface. Accordingly, the flange's top surface facing outward can contact with the rear surface of the rim as well. Moreover, when the flange is disposed over an entire circumference in a peripheral direction of the cylinder-shaped holder, it is possible to inhibit stresses from being applied to the cylinder-shaped holder of the panel body locally. In addition, when the rim is disposed over an entire circumference in a peripheral direction of the cylinder, stresses are much less likely to apply to the cylinder of the button body as well as the cylinder-shaped holder of the panel body locally.

In the present push button, a cross-sectional shape of the flange is not limited in particular. That is, the flange can be formed as any cross-sectional shape which protrudes radially inward from an inner peripheral surface of the cylinder-shaped holder. Note that the flange receives a force from the rim, force which pushes the button body into the panel body. Consequently, the flange can be formed as a cross-sectional shape which can withstand the force. As for a cross-sectional shape of the flange, it is possible to name convexed cross-sectional shapes protruding radially inward, and "U"-shaped cross-sectional shapes, for instance. Moreover, the flange can be formed as a cross-sectional shape whose rear surface has such a diameter that it reduces from large to small axially inward so as to be continuous with an axially-inward inner peripheral surface of the cylinder-shaped holder. In other words, the rear surface of the flange can be tapered from large to small axially inward.

It is preferred that one of the button body and the panel body can further comprise a tapered surface and the other one of them can further comprise a boss. The tapered surface is disposed at a position where the cylinder and the cylinder-shaped holder face to each other, and is inclined with respect to an axial direction of the one of the button body and the panel body. The boss is to be brought into contact with the tapered surface. When one of the button body and the panel body comprises the tapered surface and the other one of them comprises the boss, the tapered surface and the boss guide the movement of the button body when the button body returns from the pressed-in state to the non-pressed state, or vice versa. Moreover, the tapered surface and the boss improve the positioning accuracy of the button body, because they carry out positioning the button body with respect to the panel body. Note that the boss disposed in the other one of the button body and the panel body herein designates a shape being guided by the tapered surface. For example, the boss can be formed as convexed shapes or tapered shapes agreeing with the tapered surface substantially.

It is preferable to dispose the flange over an entire circumference in a peripheral direction of the cylinder-shaped holder. When the flange is disposed over an entire circumference in a peripheral direction of the cylinder-shaped holder, stresses applied to the flange are less likely to concentrate on the flange when the button body is pressed into the panel body so that the rim contacts with the flange.

Moreover, when the button body is provided with the rim disposed over an entire circumference in a peripheral direction of the cylinder, or when the cylinder-shaped body is provided with the flange disposed over an entire circumference in a peripheral direction of the cylinder-shaped holder, the rim or the flange is visible through a clearance between the presser and the cylinder-shaped holder upon pushing the button body into the cylinder-shaped holder of the panel body. Thus, the rim or the flange shields the clearance. Accordingly, the inside of the main body within the panel body is invisible. As a result, it is possible to inhibit the decorative appearance of the present button from degrading when operating the present push button.

In addition, the present push button comprises paired facing surfaces, a first facing surface being a part of an outer peripheral surface of the cylinder and a second facing surface being a part of an inner peripheral surface of the cylinder-shaped holder facing the first facing surface. One of the paired facing surfaces can preferably comprise a rib protruding toward the other one of the paired facing surfaces; and the other one of the paired facing surfaces can preferably comprise a guide groove into which the rib is fitted.

Specifically, the paired facing surfaces comprise an outward-facing section of an outer peripheral surface of the cylinder, and an inward-facing section of an inner peripheral surface of the cylinder-shaped holder facing to the outward-facing section. A rib is formed on one of the paired facing surfaces, a guide groove is formed in the other one of the paired facing surfaces, and the rib is fitted into the guide groove. The movement of the rib fitted into the guide groove is regulated only in the extending direction of the guide groove. As a result, the moving direction of the button body is controlled only in the movable direction of the rib. Consequently, no button-body movements take place other than in the extension direction of the guide groove.

Note that the guide groove guides the rib, which is fitted into the guide groove, in the extending direction of the guide groove. Accordingly, the guide groove can preferably be formed so as to extend in an axial direction of the cylinder of the button body. When the guide groove is formed so as to extend in an axial direction of the cylinder, no interference occurs between the cylinder of the button body and the cylinder-shaped holder of the panel body upon pushing the presser of the button body into the panel body.

In the present push button, the rib can be formed either on the inward-facing section of an inner peripheral surface of the cylinder-shaped holder or on the outward-facing section of an outer peripheral surface of the cylinder. For example, the rib can be formed on the outward-facing section of an outer peripheral surface of the cylinder; and the guide groove can be formed in the inward-facing section of an inner peripheral surface of the cylinder-shaped holder. Alternatively, the guide groove can be formed in the outward-facing section of an outer peripheral surface of the cylinder; and the rib can be formed on the inward-facing section of an inner peripheral surface of the cylinder-shaped holder.

In the present push button, a shape of the rib is not limited in particular. That is, the rib can be formed as any shape which enables the cylinder or the cylinder-shaped holder to move along the guide groove when the rib is fitted into the guide groove. For example, the rib can be formed as a substantial plate shape or a substantial rod shape which protrudes toward the guide groove.

In the present push button, a cross-sectional shape of the guide groove is not limited in particular. That is, the guide groove can be made by forming one of the paired facing surfaces as a cross-sectionally recessed shape, or can be a slit formed in one of the paired facing surfaces. In view of forming readiness, the guide groove can preferably comprise a slit formed in one of the facing surfaces.

The present push button can preferably further comprise a circuit substrate equipped with a switch, the circuit substrate disposed apart from a rear surface of the panel body by a minor distance, and urging means disposed in the switch and urging the button body in a direction separating the button body from the circuit substrate. In the circuit substrate, an electric circuit is formed which is turned on or off by the present push button by way of the switch disposed in the electric circuit. Moreover, the urging means disposed in the switch keeps the present push button so that the presser of the button body is unpressed.

Moreover, the pressing surface of the presser of the button body and an external surface of the main body of the panel body can preferably be flush with each other. When the pressing surface of the presser and an external surface of the main body are flush with each other, the button body does not protrude from an external surface of the main body of the panel body. As a result, the decorative appearance of the present push button upgrades.

In the present push button, an outer peripheral shape of the cylinder and an inner peripheral shape of the cylinder-shaped holder are not limited in particular. The respective shapes herein designate their axially perpendicular cross-sectional shape. For example, it is possible to name such shapes as circular shapes, oval shapes and orthogonal shapes. A preferable shape can be an orthogonal shape, because its inherent shape hardly causes peripheral misalignment.

Materials of the button body and panel body, the component parts of the present push button, are not limited in particular.

In addition, the button body can preferably comprise a cylindrical member having opposite ends and displacing in the cylinder-shaped holder of the panel body, and a pressing member assembled with one of the opposite ends of the cylindrical member and forming the pressing surface. When the button body comprises the cylindrical member and the pressing member, it is possible to change the decorativeness of the pressing surface readily. Further, it is possible to produce the button body provided with various pressing surfaces with ease. Furthermore, the button body with such an arrangement can be assembled readily by simply fitting the cylindrical member and the pressing member into the cylinder-shaped holder of the panel body through the opposite ends of the cylinder-shaped holder.

EXAMPLES

Hereinafter, the present invention will be described in detail with reference to specific examples. A few of push buttons were manufactured as examples of the present invention.

Example No. 1

Figure 2:
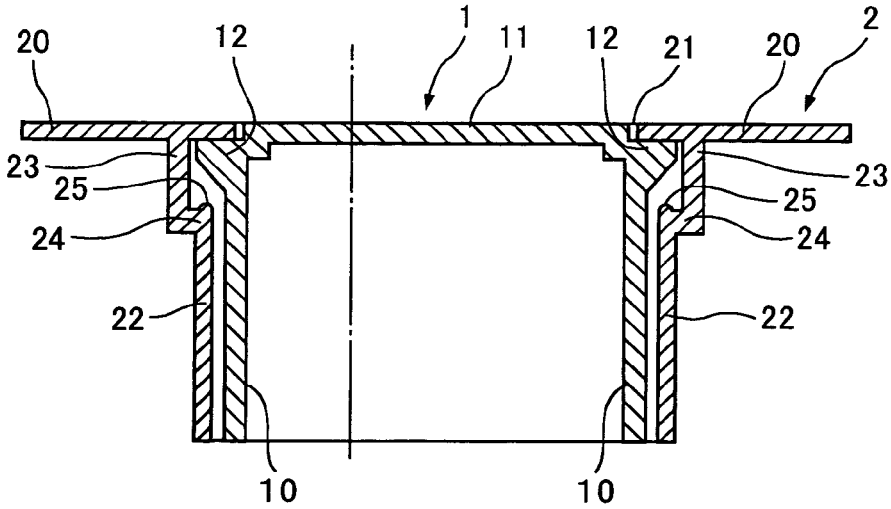
FIG. 2 is a cross-sectional view of the push button according to Example No. 1, taken along the chain line "2"—"2" of FIG. 1.
Figure 3:
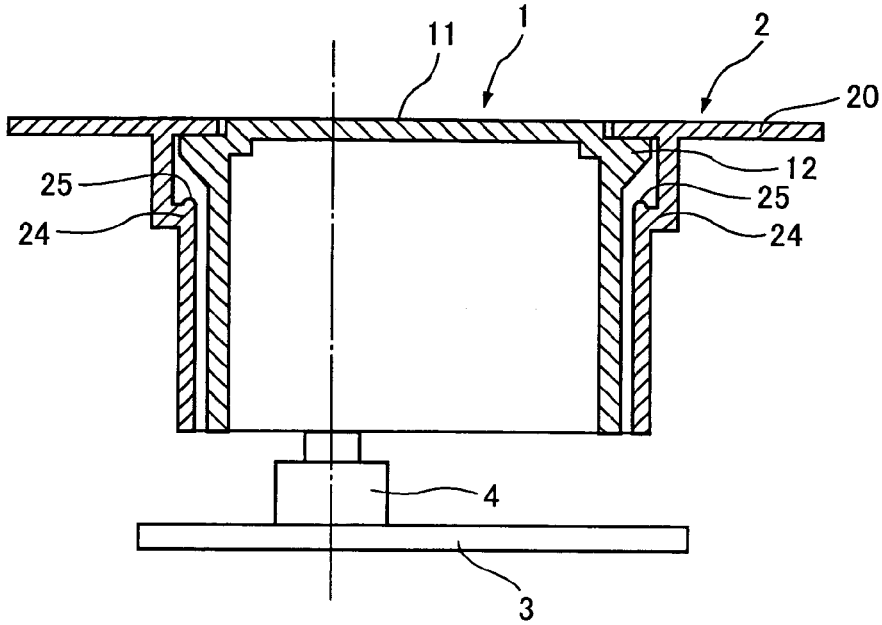
FIG. 3 is a cross-sectional view for illustrating a disposition of component parts of the push button according to Example No. 1 in service.
Figure 4:
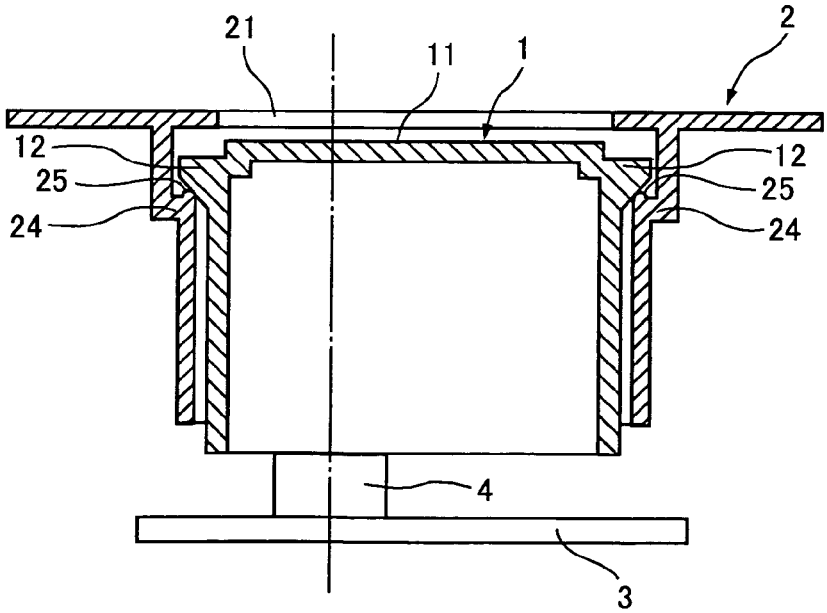
FIG. 4 is a cross-sectional view for illustrating a disposition of component parts of the push button according to Example No. 1 when a button body, one of the component parts, is pressed.

Example No. 1 of the present invention is a push button whose arrangement is illustrated in FIGS. 1 through 4. FIG. 1 illustrates a perspective view of the push button according to Example No. 1 of the present invention. FIG. 2 illustrates a cross-sectional view of the push button according to Example No. 1, taken along the chain line "2"—"2" of FIG. 1. Moreover, FIGS. 3 and 4 illustrate a cross-sectional view of the push button according to Example No. 1 in operation, respectively.

As illustrated in the drawings, the push button according to Example No. 1 comprises a button body 1, and a panel body 2.

The button body 1 comprises a cylinder 10, a presser 11, and a rim 12. The cylinder 10 is formed as a cylinder shape whose cross section is a rectangular shape substantially. The presser 11 is disposed at one of the opposite ends of the cylinder 10 (e.g., an outer opposite end), and forms a pressing surface. The rim 12 is disposed adjacent to the rear surface of the presser 11, and protrudes radially outward and stepwise axially inward from a portion of the cylinder 10 adjacent to the outer opposite end. Note that the rim 12 is disposed over an entire circumference in a peripheral direction of the cylinder 10. The presser 11 has a substantially rectangular shape forming the pressing surface. Moreover, the presser 11 has an outer peripheral shape agreeing with an outer peripheral shape of the cylinder 10 substantially. In addition, the rear side of the rim 12 is formed as a tapered surface which inclines from wide to small in a direction away from the outer opposite end of the cylinder 10.

The panel body 2 comprises a main body 20, and a cylinder-shaped holder 22. The main body 20 has an external surface which is substantially flush with an external surface (i.e., the pressing surface) of the presser 11 of the button body 1. The cylinder-shaped holder 22 protrudes axially inward from the rear surface of the main body 20, and holds the button body 1 therein so as to enable the button body 1 to reciprocate in the axial direction of the cylinder 10.

The cylinder-shaped holder 22 of the panel body 2 is provided with an opening 21 which is formed in the external surface of the main body 20. The cylinder-shaped holder 22 is formed as a substantially rectangular cylinder whose cross section is slightly greater than an outer periphery of the cylinder 10 of the button body 1. The opening 21 of the panel body 20 is formed as a substantially orthogonal shape which is slightly greater than an outer peripheral shape of the presser 11 of the button body 1. Moreover, the cylinder-shaped holder 20 comprises an inward-facing section 23. The inward-facing section 23 faces the rim 12 of the button body 1, and is formed as a substantially orthogonal shape which is slightly greater than an outer peripheral shape of the rim 12.

In addition, the panel body 2 further comprises a flange 24. The flange 24 is disposed at an inner position inward with respect to the opening 21 of the main body 20 of the panel body 2, to be more precise, at the inner opposite end of the inward-facing section 23 of the cylinder-shaped holder 22. Note that the flange 24 is disposed over an entire circumference in a peripheral direction of the cylinder-shaped holder 22. The flange 24 has a contact boss 25 whose cross section is formed as a convexed shape. The contact boss 25 is disposed at the leading end of the flange 24, and protrudes outward from the inner surface of the flange 24.

As shown in FIGS. 3 and 4, the push button according to Example No. 1 is used to turn on or off a switch 4 which is disposed on a circuit substrate 3. The switch 4 is provided with urging means (not shown). The urging means urges the button body 1 in a direction separating the button body 1 from the circuit substrate 3, and keeps the pressing surface of the presser 11 of the button body 1 to be substantially flush with the external surface of the main body 20 of the panel body 2. As for the urging means, a spring is used herein, for instance.

When the push button according to Example No. 1 is not in operation, the pressing surface of the presser 11 of the button body 1 is kept being substantially flush with the external surface of the main body 20 of the panel body 2.

When operating the push button according to Example No. 1, the presser 11 of the button body 1 is pressed to turn on or off the switch 4. The button body 1 is pressed into the cylinder-shaped holder 22 of the panel body 2. In this instance, the presser 11 of the button body 1 is pressed in along the cylinder-shaped holder 22. Then, the tapered surface of the rim 12 contacts with the contact boss 25 of the flange 24. The contact between the tapered surface and the contact boss 25 guides the presser 11 of the button body 1 being pressed in. Thus, no interference occurs between the button body 1 and the panel body 2 when the button body 1 is pressed in, because the tapered surface and the contact boss 25 guide the button body 1.

When the button body 1 is pressed in, the rim 12 of the button body 1 is pressed against the contact boss 25 of the flange 24 as illustrated in FIG. 4. Accordingly, the button body 1 is inhibited from moving further inward. That is, the button body 1 is prevented from being pressed in more than it is illustrated in FIG. 4. At this moment, the switch 4 disposed on the circuit substrate 3 is turned on or off.

As described above, the flange 24 determines the pushing-in magnitude for the button body 1. Accordingly, even when an operator tries to push in the button body 1 excessively, the button body 1 is pressed in only by a magnitude necessary for turning the switch 4 on or off. Consequently, it is possible to turn the switch 4 on or off without applying excessive forces to the circuit substrate 3 and the switch 4.

When the flange 24 keeps the button body 1 from moving further inward, the rim 12 of the button body 1 is visible through a clearance between the outer periphery of the presser 11 and the inner periphery of the opening 21 of the panel body 2, but the rim 12 makes the interior circuit substrate 3 inside the panel body 2 invisible.

Thereafter, when the force applied to the presser 11 is released, that is, when an operator removes his or her finger off the presser 11, the urging means of the switch 4 moves the button body 1 back to the original position as shown in FIG. 3.

As described above, in the push button according to Example No. 1, the flange 24 and the rim 12 regulate the pushing-in magnitude of the button body 1. As a result, the push button according to Example No. 1 does not apply excessive loads to the circuit substrate 3 and switch 4. Accordingly, no damages occur in the circuit substrate 3 and switch 4. Moreover, it is impossible to see the inside of the panel body 2 through the clearance between the outer periphery of the presser 11 and the inner periphery of the cylinder-shaped holder 22, because the rim 12 of the button body 1 functions as a blind. Consequently, the push button according to Example No. 1 is inhibited from degrading in terms of the decorative appearance.

Example No. 2

Figure 5:
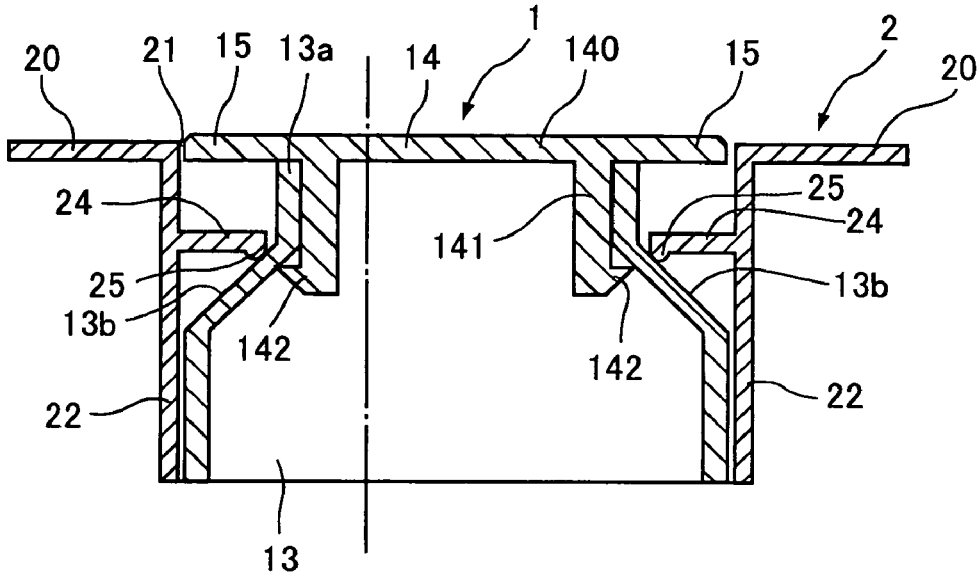
FIG. 5 is a cross-sectional view for illustrating a push button according to Example No. 2 of the present invention.

Example No. 2 of the present invention is a push button whose arrangement is illustrated in FIG. 5. FIG. 5 illustrates a cross-sectional view of the push button according to Example No. 2 of the present invention, taken similarly to FIG. 2. As shown in the drawing, the push button according to Example No. 2 has a substantially identical shape with that of the push button according to Example No. 1.

As illustrated in FIG. 5, the push button according to Example No. 2 likewise comprises a button body 1, and a panel body 2.

The button body 1 comprises a cylindrical member 13, and a pressing member 14. The cylindrical member 13 has a diametrically-reducing portion adjacent to one of the opposite ends, an outer end 13*a*. The pressing member 14 is fitted into the outer end 13*a* of the pressing member 13, is engaged with the diametrically-reducing portion of the pressing member 13, and forms a pressing surface. The cylindrical member 13 is formed in the following manner: the outer end 13*a* has a smaller diameter than that of the inner end; and the diametrically-reducing portion has an outer peripheral surface 13*b* inclined with respect to the axial direction of the cylindrical member 13. The pressing member 14 has a plate-shaped pressing external portion 140, and an engagement portion 141. The pressing external portion 140 has a substantially rectangular shape forming the pressing surface. The engagement portion 141 protrudes axially inward from the rear surface of the pressing external portion 140, is fitted into the outer end 13*a* of the cylindrical member 13, and has an engagement claw 142 at the leading end. The engagement claw 142 protrudes radially outward. Moreover, the pressing external portion 140 has an outer peripheral shape which substantially agrees with an outer peripheral shape of the cylindrical member 13 excepting the outer end 13*a* and diametrically-reducing portion. In other words, the pressing external portion 140 has a rim 15. The rim 15 protrudes beyond the outer periphery of the outer end 13*a* of the cylindrical member 13 when the pressing external portion 140 is assembled with the cylindrical member 13 to make the button body 1.

The panel body 2 comprises a main body 20, and a cylinder-shaped holder 22. The main body 20 has an external surface which is substantially flush with an external surface (i.e., the pressing surface) of the pressing member 14 of the button body 1. The cylinder-shaped holder 22 protrudes axially inward from the rear surface of the main body 20, and holds the button body 1 therein so as to enable the button body 1 to reciprocate in the axial direction of the cylindrical member 13.

The cylinder-shaped holder 22 of the panel body 2 is provided with an opening 21 which is formed in the external surface of the main body 20. The cylinder-shaped holder 22 is formed as a substantially rectangular cylinder whose cross section is slightly greater than an outer periphery of the outer peripheral shape of the cylindrical member 13 excepting the outer end 13*a* and diametrically-reducing portion. Moreover, the cylinder-shaped holder 22 is formed as a substantially orthogonal shape, which is slightly greater than an outer peripheral shape of the pressing member 14 of the button body 1, adjacently to the opening 21.

In addition, the panel body 2 further comprises a flange 24. The flange 24 is disposed at an inner position slightly inward with respect to the opening 21 of the cylinder-shaped holder 20 of the panel body 2. Note that the flange 24 is disposed so as to be positioned above the diametrically-reducing portion of the cylindrical member 13 of the button body 1 when the button body 1 is assembled with the panel body 2.

The flange 24 has a contact boss 25 whose cross section is formed as a convexed shape. The contact boss 25 is disposed at the leading end of the flange 24, and protrudes axially inward from the rear surface of the flange 24. Note that the contact boss 25 is disposed over an entire circumference in a peripheral direction of the flange 24.

The push button according to Example No. 2 can be assembled in the following manner. The cylindrical member 13 of the button body 1 is fitted into the cylinder-shaped holder 22 through the rear side of the panel body 2. Then, the engagement portion 141 of the pressing member 14 is fitted into the outer end 13*a* of the cylindrical member 13. Finally, the engagement claw 142 is engaged with the inner periphery of the diametrically-reducing portion of the cylindrical member 13 which forms the inclined outer peripheral surface 13*b* in the cylindrical member 13.

The push button according to Example No. 2 effects advantages in the same manner as the push button according to Example No. 1. In the push button according to Example No. 2, note that, however, the contact boss 25 guides the cylindrical member 13 when the pressed-in button body 1 returns to the original state shown in FIG. 5. Moreover, in the push button according to Example No. 2, the flange 24 of the panel body 2 makes an interior circuit substrate inside the panel body 2 invisible through a clearance between the outer periphery of the pressing member 14 of the button body 1 and the opening 21 of the panel body 2, instead of the rim 15 of the pressing member 14 of the button body 1.

Example No. 3

Figure 6:
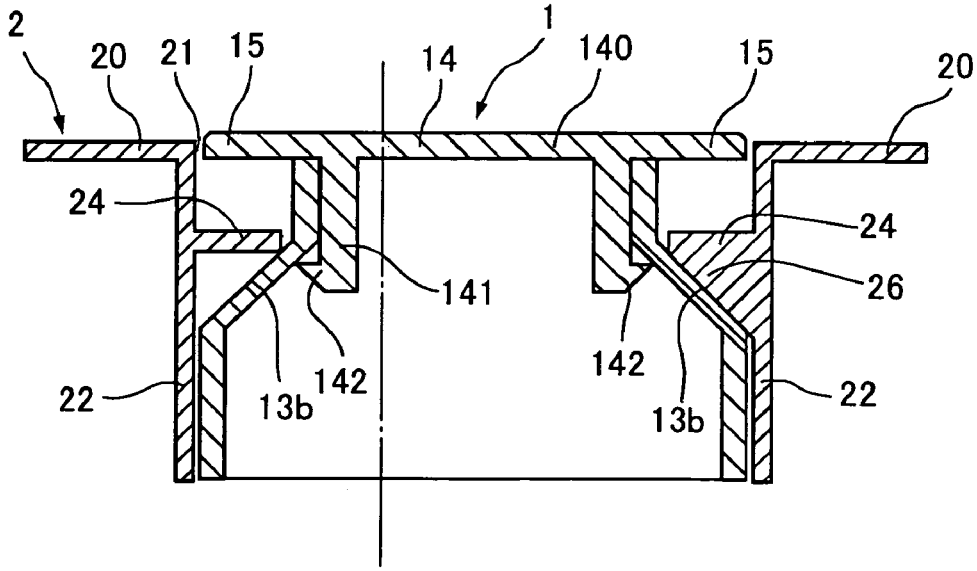
FIG. 6 is a cross-sectional view for illustrating a push button according to Example No. 3 of the present invention.

A push button according to Example No. 3 of the present invention is a modified version of the push button according to Example No. 2. FIG. 6 illustrates an arrangement the push button according to Example No. 2. FIG. 6 shows a cross-sectional view of the push button according to Example No. 2, taken similarly to FIG. 5.

As illustrated in FIG. 6, except that the rear side of the flange 24 is formed as tapered shapes 26 partially instead of the contact boss 25, the push button according to Example No. 2 is virtually identical with the push button according to Example No. 2.

Specifically, the rear side of the flange 24 is provided a plurality of the tapered shapes 26. The tapered shapes 26 agree with the outer peripheral shape of the inclined outer peripheral surface 13*b* of the cylindrical member 13, and are disposed so as to separate at predetermined intervals cyclically in a peripheral direction of the flange 24. Note that the intervals between the tapered shapes 26 are not limited in particular. For example, one and only tapered surface 26 can be disposed over an entire circumference in a peripheral direction of the flange 24 in the same manner as the contact boss 25 in the push button according to Example No. 2. As shown in FIG. 6, in the push button according to Example No. 3, the rear side of the flange 24 is provided with the tapered shape 26 on the right side with respect to the chain line of the drawing, but the rear side of the flange 24 is free from the tapered shape 26 on the left side with respect to the chain line.

Except that the rear side of the flange 24 is formed as the tapered shapes 26 partially, the push button according to Example No. 3 comprises the same component parts as the push button according to Example No. 2. Hence, it is apparent that the push button according to Example No. 3 operates and effects advantages in the same manner as the push button according to Example No. 2.

Modified Versions

Heretofore, a few of the embodiment modes of the present push button are described. However, the embodiment modes are not limited to the above-described embodiment modes particularly. It is possible to perform the present push button in various modified embodiment modes or improved embodiment modes which one of ordinary skill in the art can carry out.

Figure 7:
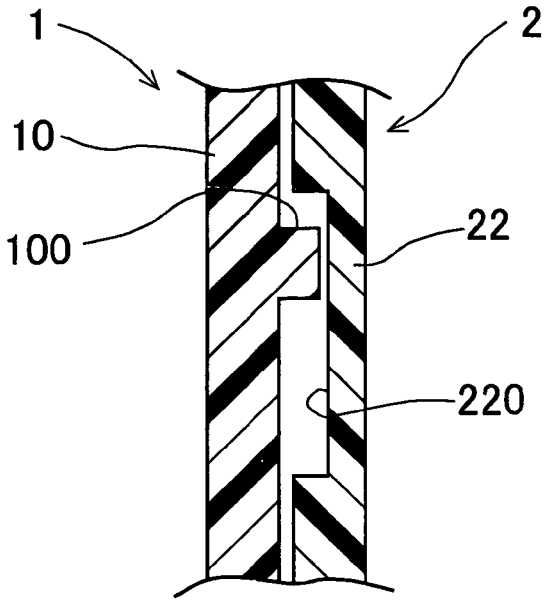
FIG. 7 is an enlarged cross-sectional view for partially illustrating a push button according to a modified version of the present invention.
Figure 8:
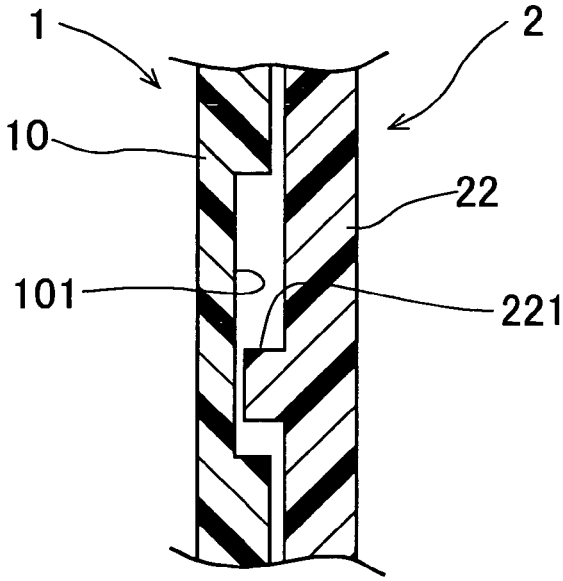
FIG. 8 is an enlarged cross-sectional view for partially illustrating a push button according to another modified version of the present invention.

In order to upgrade the positioning accuracy of the button body 1 with respect to the panel body 2 or vice versa, as illustrated in FIG. 7, a rib 100 can be formed on an outward-facing section of an outer peripheral surface of the cylinder 10 of the button body 1, and a guide groove 220 can be formed in an inward-facing section of an inner peripheral surface of the cylinder-shaped holder 22 of the panel body 2, for instance. Alternatively, as illustrated in FIG. 8, a guide groove 101 can be formed in an outward-facing section of an outer peripheral surface of the cylinder 10 of the button body 1, and a rib 221 can be formed on an inward-facing section of an inner peripheral surface of the cylinder-shaped holder 22 of the panel body 2.

Having now fully described the present invention, it will be apparent to one of ordinary skill in the art that many changes and modifications can be made thereto without departing from the spirit or scope of the present invention as set forth herein including the appended claims.

What is claimed is:

1. A push button comprising:

a button body comprising: a cylinder having opposite ends and an outer peripheral shape; a presser disposed at one of the opposite ends of the cylinder and forming a pressing surface; and a rim protruding beyond the outer peripheral shape of the cylinder and having a rear surface opposite the pressing surface;

a panel body comprising: a cylinder-shaped holder holding the button body therein so as to enable the button body to reciprocate in an axial direction of the cylinder, the cylinder-shaped holder having an opening; a main body demarcating the opening of the cylinder-shaped holder; and a flange protruding radially inward and having a leading end to be brought into contact with the rear surface of the rim; and a circuit substrate equipped with a switch, the circuit substrate disposed apart from a rear surface of the panel body by a minor distance; and urging means disposed in the switch and urging the button body in a direction separating the button body from the circuit substrate, wherein one of the button body and the panel body further includes a tapered surface at a position where the cylinder and the cylinder-shaped holder face each other, the tapered surface being inclined with respect to an axial direction of the one of the button body and the panel body.

2. The push button set forth in claim 1, wherein:

the other one of the button body and the panel body further comprises a boss to be brought into contact with the tapered surface.

3. The push button set forth in claim 1, wherein the rim of the button body is disposed adjacent to the presser thereof.

4. The push button set forth in claim 1, wherein the flange of the cylinder-shaped holder is disposed over an entire circumference in a peripheral direction of the cylinder-shaped holder.

5. The push button set forth in claim 3, wherein the rim of the button body is disposed so as to radially extend outward from the presser thereof.

6. The push button set forth in claim 5, wherein the rim of the button body extends from the presser thereof stepwise axially inward.

7. The push button set forth in claim 1, wherein the rim of the button body is disposed over an entire circumference in a peripheral direction of the cylinder.

8. The push button set forth in claim 1, wherein the pressing surface of the presser of the button body and an external surface of the main body of the panel body are flush with each other.

9. The push button set forth in claim 1, wherein an external surface of the main body of the panel body protrudes radially inward toward the presser.

10. The push button set forth in claim 1 further comprising paired first and second facing surfaces, the first facing surface being a part of an outer peripheral surface of the cylinder, the second facing surface being a part of an inner peripheral surface of the cylinder-shaped holder facing the first facing surface; a guide groove formed in the second facing surface; and a rib disposed on the first facing surface to protrude toward the second facing surface and so as to be fitted into the groove.

11. The push button set forth in claim 1 further comprising paired first and second facing surfaces, the first facing surface being a part of an outer peripheral surface of the cylinder, the second facing surface being a part of an inner peripheral surface of the cylinder-shaped holder facing the first facing surface; a guide groove formed in the first facing surface; and a rib disposed on the second facing surface to protrude toward the first facing surface and so as to be fitted into the groove.

12. The push button set forth in claim 1, wherein the button body comprises:

a cylindrical member having opposite ends and displacing in the cylinder-shaped holder of the panel body, thereby functioning as the cylinder; and a pressing member assembled with one of the opposite ends of the cylindrical member and forming the pressing surface, thereby functioning as the presser.

13. The push button according to claim 1, wherein the cylinder of the button body comprises a major opposite end, a minor opposite end, and a diametrically-reducing portion connecting the major opposite end with the minor opposite end and having a diameter reducing from large to small in a direction away from the major opposite end to the minor opposite end.

14. The push button according to claim 13, wherein the flange of the panel body contacts with the diametrically-reducing portion of the cylinder of the button body.

15. The push button according to claim 14, wherein the flange of the panel body guides the cylinder of the button body upon releasing the button body from a pressed state to an unpressed state.

16. The push button according to claim 13, wherein the flange of the panel body has a boss at the leading end.

17. The push button according to claim 16, wherein the boss is disposed over an entire circumference in a peripheral direction of the flange.

18. The push button according to claim 13, wherein the flange of the panel body has a rear side which is formed as a tapered shape agreeing with the diametrically-reducing portion of the cylinder of the button body.

19. The push button according to claim 18, wherein a plurality of the tapered shapes are disposed at intervals in a peripheral direction of the flange.

20. The push button according to claim 18, wherein the tapered shape is disposed over an entire circumference in a peripheral direction of the flange.

* * * * *